United States Patent [19]

Anderson

[11] Patent Number: 4,840,592

[45] Date of Patent: Jun. 20, 1989

[54] POWER DRIVEN UNDERWATER VIEWING PLATFORM

[76] Inventor: Allen B. Anderson, P.O. Box 847, Big Fork, Mont. 59911

[21] Appl. No.: 14,590

[22] Filed: Feb. 13, 1987

[51] Int. Cl.[4] ..... B63C 11/00

[52] U.S. Cl. ..... 441/135; 114/66; 440/84; 440/87; 441/65

[58] Field of Search ..... 441/135, 65, 74; 114/66, 315, 144 R; 440/62, 84, 86, 87, 6

[56] References Cited

U.S. PATENT DOCUMENTS

| | | | |
|---|---|---|---|
| Re. 28,176 | 10/1974 | Horton | 440/62 |
| 756,244 | 4/1904 | Larson | 114/66 |
| 1,675,964 | 7/1928 | Weinreich | 114/66 |
| 2,135,907 | 11/1938 | Miller | 440/62 |
| 2,470,137 | 5/1949 | Brown | 114/144 R |
| 2,712,139 | 7/1955 | Kelly | 441/135 |
| 2,717,399 | 9/1955 | Backhouse | 441/135 |
| 2,867,132 | 1/1959 | Schroeder | 440/86 |
| 2,926,365 | 3/1960 | Wilcoxon | 441/135 |
| 3,042,945 | 6/1962 | Saeman | 441/135 |
| 3,081,726 | 3/1963 | Betts et al. | 114/66 |
| 3,324,819 | 6/1967 | Tetyak | 441/135 |
| 3,808,621 | 5/1974 | French | 441/135 |
| 4,602,589 | 7/1986 | Quinata | 114/315 |

FOREIGN PATENT DOCUMENTS

| | | | |
|---|---|---|---|
| 213514 | 10/1957 | Austria | 114/315 |
| 3221711 | 12/1983 | Fed. Rep. of Germany | 441/135 |
| 987832 | 8/1951 | France | 441/135 |
| 1254432 | 1/1961 | France | 114/66 |
| 251480 | 1/1927 | Italy | 114/66 |
| 1171591 | 11/1969 | United Kingdom | 441/135 |
| 1397456 | 6/1975 | United Kingdom | 441/135 |

*Primary Examiner*—Sherman D. Basinger
*Assistant Examiner*—Thomas J. Brahan
*Attorney, Agent, or Firm*—Victor Flores; Harry M. Weiss

[57] ABSTRACT

An underwater viewing platform is described which has a stern mounted electric drive motor whose direction and speed may by varied by forward mounted controls located adjacent the prone-lying operator's hands near a large forward mounted viewing window. A shade cowl arches up over the viewing window and has a U-shaped stern-facing, padded opening for receiving the operator's head. With the operator's head in place, the large viewing window is substantially shaded from overhead sunlight and has a large viewing angle and field of view. The window has a lens for providing the desired degree of magnification or demagnification. Bottom illumination is provided by an underwater light for night time use. Navigation and battery status and drain instruments are conveniently mounted within or on the shade cowl. Various design features reduce operator fatigue and extend useful range and endurance. End useful range and endurance.

16 Claims, 2 Drawing Sheets

POWER DRIVEN UNDERWATER VIEWING PLATFORM

This invention relates to an underwater viewing device useful for recreational, educational, or exploratory purposes, and more particularly, to a powered steerable flotation platform adapted to support a person in a prone position with his or her face above a shaded underwater viewing port.

Flotation devices containing ports or windows for underwater viewing are known in the art. Examples are described in U.S. Pat. Nos. 2,712,139; 2,717,399; 2,926,365; 3,042,945; 3,081,726; and 3,808,621. In some cased the user lies prone on a flotation raft and propels the raft by swimming. In other cases the user sits and peddles a bicycle like arrangement to turn a screw propeller. The raft may be elongated, circular, or Y-shaped. The user's head is positioned above a window or opening in the raft which looks toward the bottom. Transparent panes are commonly used in the viewing window to provide a clear underwater view. The panes are usually flat, however U.S. Pat. No. 3,808,621 describes a circular flotation pillow having a circular viewing area with a concave upper window and convex lower window for correction of underwater magnification.

These various prior art devices suffer from a number of disadvantages. For example, (1) all must be propelled by the user either by swimming or by peddling which interferes with viewing since optimal body positions for such activity are generally not optimal for viewing, (2) no directional control rudder or steering mechanism is provided, (3) the viewing windows are shaded from an overhead sun primarily by the viewers face and head making it difficult to provide adequate shading and often requiring awkward head positions, (4) even when a cushioned head rest is provided to permit the viewer to close off the viewing window with his face to avoid interference from the sun, the arrangement generally partially obstructs free breathing by the viewer, and (5) the user is easily fatigued by the need to propel the viewing raft by his own energy, thereby limiting the possible range and duration of viewing. Therefore, a need continues to exist for an improved underwater viewing platform which overcomes these and other deficiencies of the prior art.

Accordingly, it is an object of the present invention to provide an improved floating underwater viewing platform propelled by stored energy.

It is further an object of the present invention to provide an improved floating underwater viewing platform which has a shade cowl and head rest extending over a large viewing window in such a way as to provide substantially complete shade thereto when the viewer's face is inserted in the head rest built into the cowl and without interfering with the user's breathing.

It is an additional object of the present invention to provide an improved floating underwater viewing platform which has positive steering and variable speed propulsion so that the user may navigate without swimming or peddling.

It is a furthr object of the present invention to provide an improved floating underwater viewing platform which utilizes electric propulsion from a battery and which has a direction indicator, battery status indicator, battery drain indicator, and/or underwater lighting, and/or combinations thereof.

SUMMARY OF THE INVENTION

The forgoing and other objects and advantages of the invention are obtained by providing an elongated flotation hull having a lighter than water filling four buoyancy, and preferably of a substantially rigid material. Propulsion is desirably provided by a submersible electric motor attached to the stern by a vertical rotatable steering shaft. The motor and steering shaft are actuated by a speed control means and steering handle respectively, located near the operator's hand positions. A rod or cable desirably extends from the steering handle to a lever, gear, or pulley on the rotatable steering shaft to change the angular position of the shaft and therefore the direction of propulsion of the motor. Pulling on or tilting the steering handle conveniently changes direction.

A transparent viewing window is provided in the hull located near the bow and preferably having a lens therein with at least one curved surface. A shade cowl extends generally from the bow toward the stern above the viewing window. The cowl has a generally U-shaped opening above the window for receiving the viewer's face. The legs of the U point toward the stern and are padded to provide a cushioned support for the viewer's face. The location of the cowl and U-shaped opening with respect to the viewing window is such that when the viewer's head is in place in the U, the viewing window is substantially completely shaded from overhead sun. The space between the cowl and the viewing window extends substantially across the width of the hull and is open toward the stern so that there is no interference with the viewer's breathing.

The speed and direction controls are desirable located laterally outboard of the viewing window between the cowl and the sides of the hull in positions which may be conveniently grasped by a prone viewer. The viewer's arm rest on the deck between the cowl and the sides of the hull for comfort and to avoid fatigue.

A sealable waterproof compartment is provided in the hull for receiving the battery to drive the electric propulsion motor. A waterproof light is conveniently provided on the lower portion of the hull for underwater illumination. It is desirable to provide a direction indicator, a battery status indicator, and/or a battery discharge indicator, and/or a combination thereof in or under the cowl where they may be easily observed by the viewer while prone. The speed control desirably has a spring return switch for varying the propulsion speed of the motor, such that when released by the operator it returns automatically to the off position. A reversing switch is conveniently provided for switching the propulsion motor from forward to reverse.

The invention will be more fully understood in terms of the drawings and description which follow.

DETAILED DESCRIPTION OF THE DRAWINGS

Figure 1:
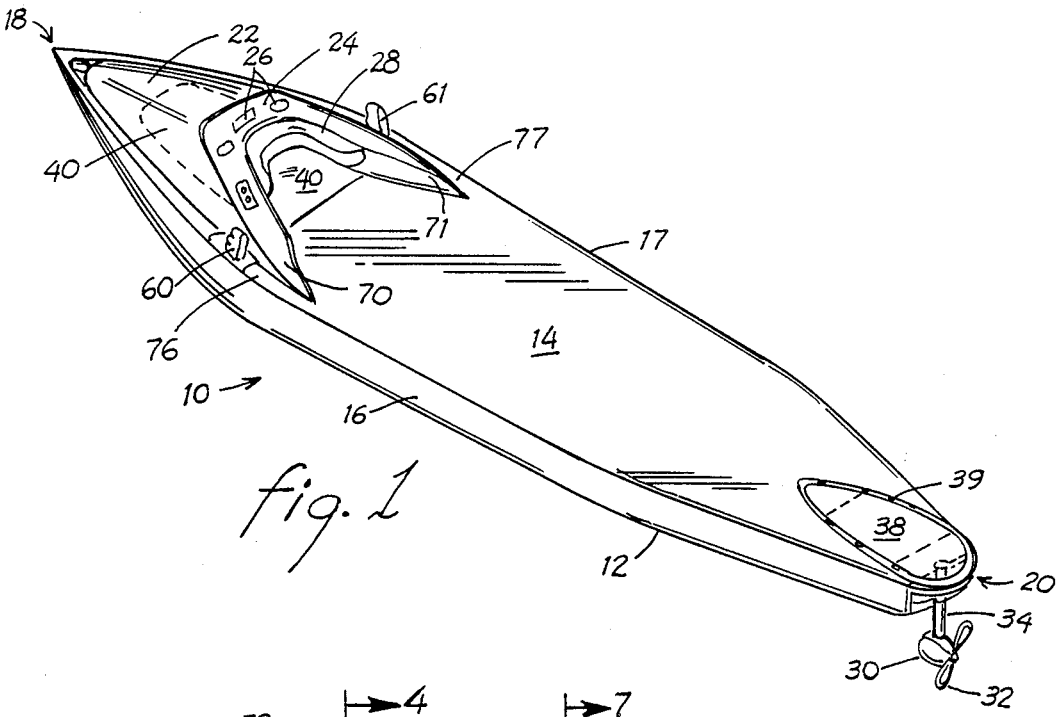
FIG. 1 is a perspective view of the floating underwater viewing platform of the present invention.
Figure 2:
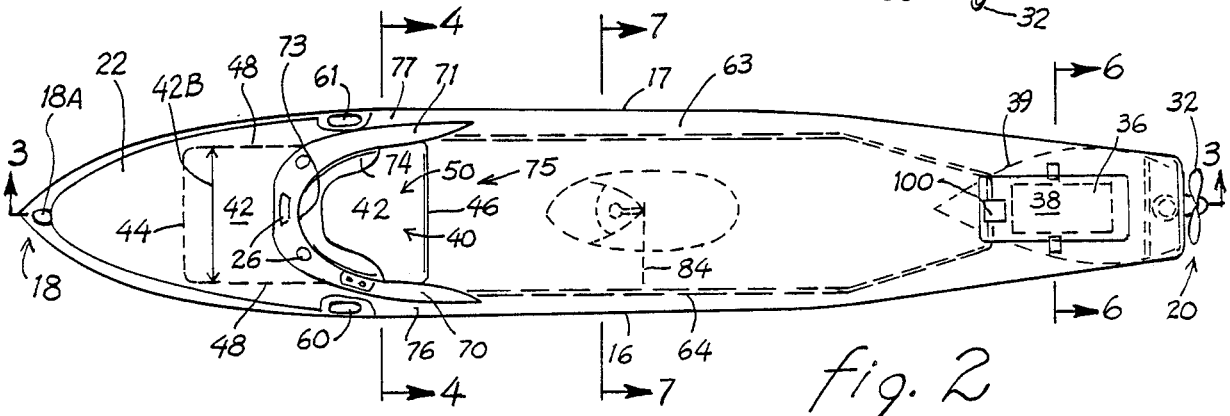
FIG. 2 is a top view of the platform of FIG. 1.
Figure 4:
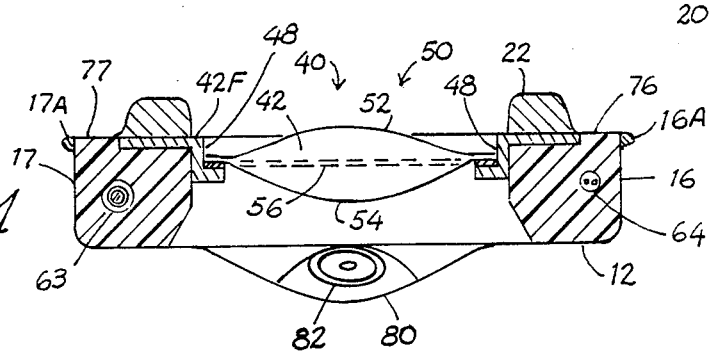
FIG. 4 is a transverse cross-sectional view of the platform of FIG. 1 through the viewing window region.
Figure 5:
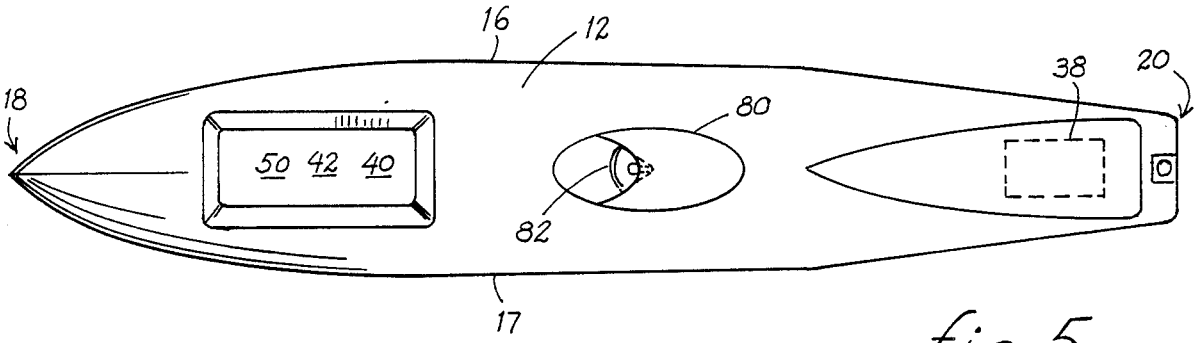
FIG. 5 is a bottom view of the platform of FIG. 1.
Figure 6:
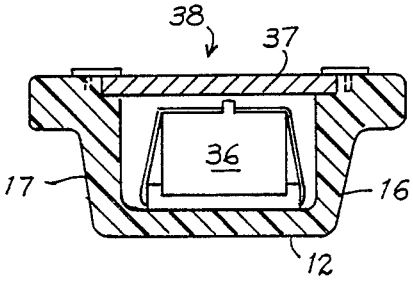
FIG. 6 is a cross-sectional view of the platform of FIG. 1 through the battery compartment region.
Figure 7:
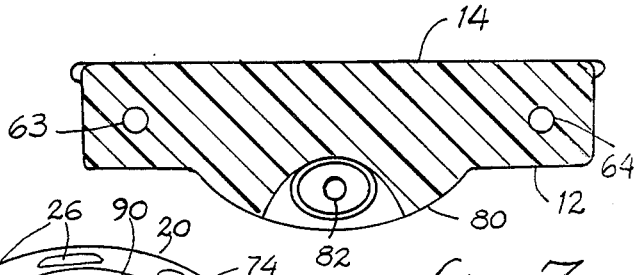
FIG. 7 is a cross-sectional view of the platform of FIG. 1 through the optional underwater light region.

A perspective view of power driven underwater viewing platform 10 is shown in FIG. 1. Platform 10 comprises hull 12 with deck 14, bow 18, stern 20 and sides 16–17. FIG. 2 is a top view, FIG. 3 a longitudinal central cross-sectional view, FIG. 5 a bottom view, FIG. 10 a stern elevation view, and FIGS. 4, 6 and 7 are transverse cross-sectional views at various points along the length of viewing platform 10, as shown in FIG. 1. The construction and features of viewing platform 10 are best understood by considering these figures together.

In normal operation, the user lies prone on deck 14 with his feet extended toward stern 20 and his head toward bow 18. Propulsion is provided by propulsion means 30, 32, 34, 36, 100 preferably comprising sealed waterproof electric motor 30 and propeller 32, mounted on support shaft 34 which is rotatably attached to platform 10 at stern 20. Power is conveniently supplied by battery 36 located in battery well 38 under battery well cover 37 and stern cowl 39. The direction of propulsion is altered by rotating shaft 34 so as to direct the thrust of propeller 32 to port or starboard. Remote steering handle 61 is conveniently provided for rotating shaft 34 through a linkage extending therebetwen in interior duct 63. The speed of rotation of propeller 32 is controlled by a variable position switch in propulsion control handle 60 which is coupled to power modulator 100 and motor 30 by electrical cables in interior duct 64. The direction of rotation of propeller 32 may be reversed so that the platform may be driven forward or backward. As will be subsequently explained, the direction reversing switch may be conveniently built into handle 60 or located elsewhere.

Opening 40 through hull 12 contains viewing window or means 50 comprising lens 42. Viewing means 50 is conveniently located distance 44A aftward of bow 18 and has length 42A and withd 42B. Viewing means 40 is located so as to be in easy viewing distance of a prone observer whose head is oriented toward bow 18.

FIG. 4 illustrates in further detail the construction of viewing window means 50 in opening 40 of platform 10. Lens 42 is provided in window 50. Lens 42 desirable has at least one curved surface 52, 54. When only one of surfaces 52, 53 is curved the other is in position 56. Varying the curvature varies the magnification provided by the lens according to well known principles. The embodiment of FIG. 4 illustrates the arrangement where both surfaces 52 and 54 are convex and flat surface location 56 is not used. However, depending upon the net magnification desired, either of surfaces 52, 54 may be convex or concave. Those of skill in the art will understand how to choose the curvature of surfaces 52, 54 to achieve the desired net magnification or demagnification of the underwater scene by lens 42. Transparent plastics are suitable for lens 42. Lens 42 is conveniently attached by frame 42F to opening 50 in platform 10. Frame 42F may extend partly under cowl 22 at sides 48 for stability and strength.

As shown in FIGS. 1–3 and 10, substantially opaque shade cowl 22 extends approximately from bow 18 up and over part of viewing window 50 so as to leave empty space 72 between cowl 22 and lens 42. Space 72 is open in the aft direction. Cowl 22 serves to partly shade viewing window 50 and to support the viewers head comfortably in a prone position. As will be subsequently explained, various instruments may also be conveniently supported in cowl 22.

Cowl 22 includes two aftward facing slightly divergent arms 70–71 which extend from portion 73 of cowl 22 toward stern 20 alongside window 50. Arms 70–71 and portion 73 of cowl 22 from U-shaped opening 75 extending toward stern 20 for accommodating the viewer's head. Resilient pad or bumper 74 is provided on the aftward surface of U-shaped opening 75 to comfortably support the viewer's face and head when lying prone on deck 14. Opening 75 and resilient pad 74 are shaped so that when the viewer's head is placed in opening 75 on pad 74, that window 50 beneath cowl 22 and opening 75 is substantially shaded from overhead sun. This is important since overhead sun shining on window 50 and lens 42 interferes with underwater viewing.

A particular feature of the present invention is that window 50 may be much larger in area than the viewer's head and still be substantially completely shaded when in use. Further, the depth of opening 40 and window 50 perpendicular to the water is substantially just the thickness of platform 10. There is no cylindrical collar or vertical extension around window 50 as in may prior art units. Such vertical collars or extensions narrow the viewing angle and the field of view. Thus, the viewing platform of the present invention provides a much wider field of view through a shaded lense than has hitherto been achieved by prior art units. This substantially convenience of use.

It is desirable that root portion 73 of cowl 22 with bumper 74 extend aftward past approximately about half the length of window 50 or more, and that arms 70–71 extend aftward approximately along the full length of window 50 or further. It is also desirable that open portion 72 under cowl 22 extend across the full width of window 50 under cowl 22 and be unobstructed from edge 44 aftward over window 50 and along sides 48 of window 50 so as to permit unrestricted viewing and free breathing by a prone viewer. This is a particular feature of the present invention.

While it is convenient to have cowl 22 extend forward approximately up to bow 18 this is not necessary. Cowl 22 may attach to deck 14 at any location between bow 18 and forward edge 44 of window 50. Cowl may be integral with deck 14 (or hull 12), but it is conveniently constructed of a separate piece and subsequently attached to deck 14. Mooring hole or ring 18A is conveniently provided adjacent bow 18. Rub rails 16A, 17A may be optionally provided along sides 16, 17 of hull 12 (see FIG. 4).

Longitudinal spaces 76, 77 are provided on deck 14 outboard of cowl 22 to serve as arm rests for the operator's arms when steering handle 61 and propulsion control handle 60 are grasped in the viewer's hands. This is a particular feature of the present invention which reduces operator fatigue. Also, cowl extensions 70, 71 desirably extend aftward past end 46 of window 50 alongside spaces 76, 77 so that the sides of cowl extensions 70, 71 may be grasped between the viewer's arms. This allows the operator to tightly grasp platform 10 while still having his hands mobile for actuating controls 60, 61. This is a further feature of the present invention which improves operator convenience and safety. Arm loops (not shown) may optionally be provided above spaces 76, 77 for receiving the operator's arms to provide for a more secure attachment to or grasp of the platform.

Figure 3:
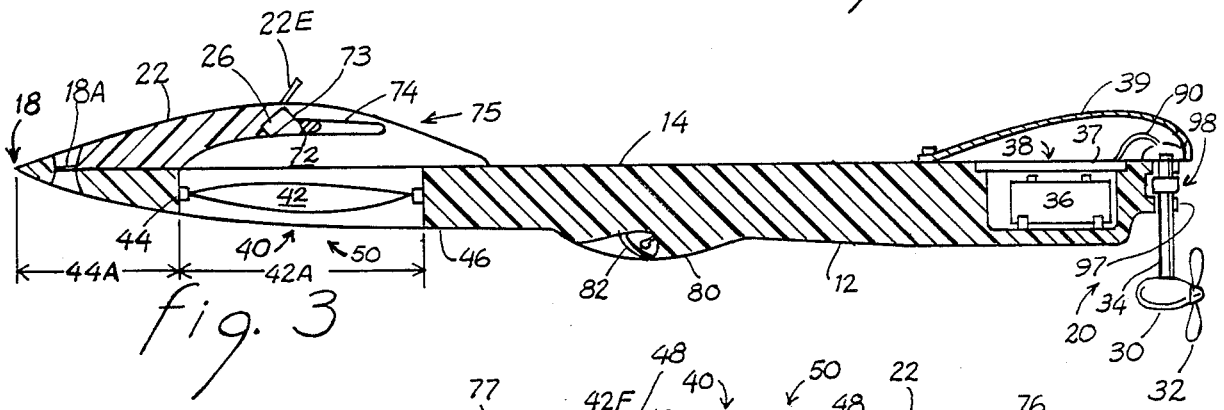
FIG. 3 is a longitudinal central cross-sectional view of the platform of FIG. 1.

Instruments 26 are conveniently supported in upper portion of U-shaped opening 75 of cowl 22 as indicated for example in FIGS. 1–3. Particularly useful instruments are a direction indicator (e.g., a compass), a battery charge status indicator (e.g., a suppressed zero voltmeter), and a battery drain indicator (e.g., an ammeter). Switches for reversing the direction of propulsion and actuating an underwater light may also be conveniently located in the edge of cowl 22, as for example at 26A (see FIG. 10), or on propulsion control handle 60 or elsewhere within easy reach of a prone viewer. Optional cowl extension 22E, illustrated in FIG. 3, is useful for shading these instruments for easier viewing.

An optional additional feature of the present invention is integral underwater light 82 mounted in housing 80 on the lower part of hull 12. Light 82 is actuated by a switch located as previously described and draws power from battery 36 through interior wire 84 (see FIG. 2). Light 82 is particularly convenient for underwater viewing at night, which has not been convenient with prior art platforms. It is desirable that light 82 be angled slightly toward bow 18 so that its central area of illumination is located approximately under viewing window 50. FIG. 7 which is a bottom view of platform 10 further illustrates the relative location of window 50 and light 82.

As noted earlier, propulsion is conveniently provided by electric motor 30 mounted at stern 20 of platform 10. Hull extensions 97 separated by gap 98 and pierced by holes 99 are conveniently provided at stern 20 of platform 10 for receiving rotatable steering shaft 34 supporting motor 30 (see FIGS. 3 and 10). Shaft 34 is conveniently retained in holes 99 in extensions 97 by clamp 92. Wires 90 extend from battery compartment 38 through shaft 34 to motor 30 to provide power to motor 30. In addition to containing battery 36, battery compartment 38 also conveniently contains speed modulator 100 actuated by propulsion control handle 60. Speed modulator 100 is conveniently a pulse width modulation unit which varies the amount of power delivered to motor 30 in response to input signals from switches or other signal means located in propulsion control handle 30. Pulse width modulation units are well known in the electronics art. Other means for varying the power delivered from battery 36 to motor 30 may also be used.

Figure 10:
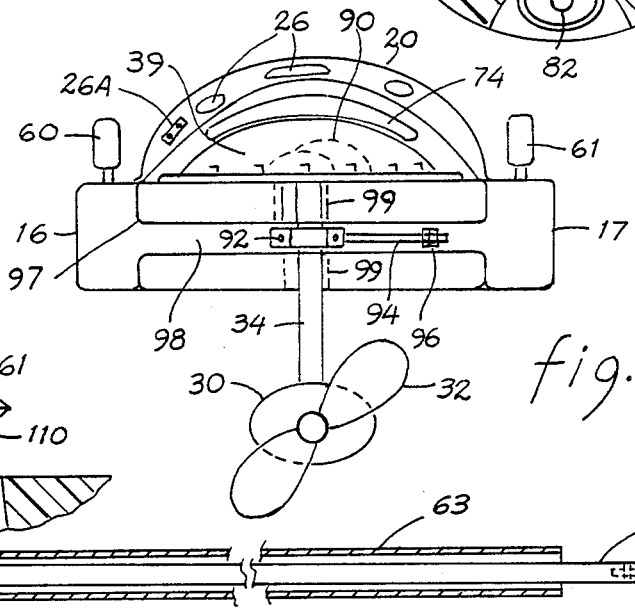
FIG. 10 is a rear elevation in simplified form of the platform of FIG. 1.
Figure 8:
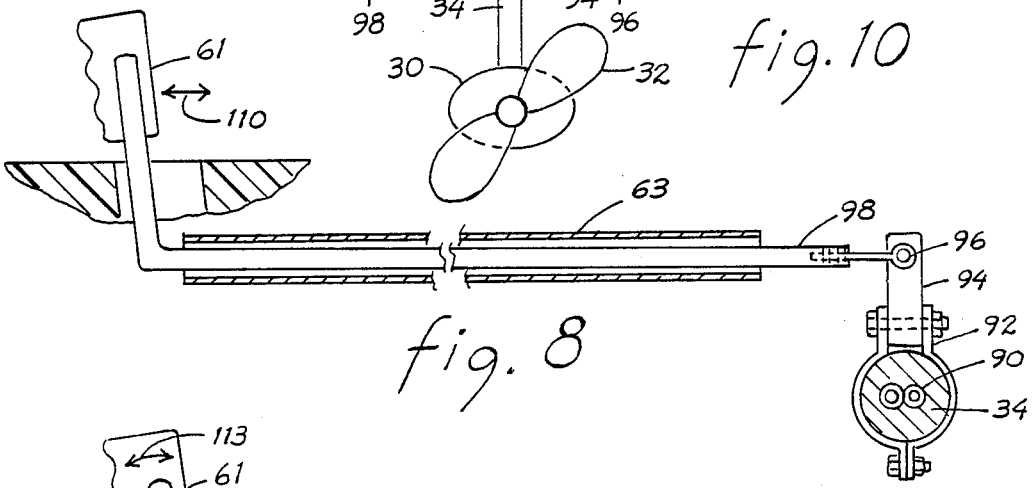
FIG. 8 is a partial cross-sectional and cut-away view of a preferred embodiment of the sterring control mechanism of the platform of FIG. 1, wherein the cross-section in the left portion is rotated 90 degrees to the cross-section in the right portion.

FIGS. 8 and 10 illustrate a preferred embodiment for coupling rotatable steering shaft 34 to steering handle 61. Those of skill in the art will understand that the portion of FIG. 8 to the right of the break is a cross-section looking down from the top of platform 10 and that the portion of FIG. 8 to the left of the break is a cross-section looking from the side of platform 10. Thus the two halves of FIG. 8 are views at ninety degrees with respect to each other.

Rotatable motor support and steering shaft 34 is held by clamp 92 which in turn is connected to lever 94 extending substantially at right angles to shaft 34 and approximately parallel to deck 14. When motor 30 is oriented to drive hull 12 straight ahead (or astern), lever 94 is conveniently oriented so as to be approximately at right angles to the longitudinal axis of hull 12. Acutation means 97 attaches to lever 94 by rotatable pivot means 96 and extends through hollow interior bore 63 to connect to external steering handle 61 (see FIG. 8). When steering handle 61 is moved fore and aft in the direction indicated by arrow 110, actuation means 97 moves pivot 96 of lever 94 thereby rotating shaft 34 and motor 30 to change the azimuthal direction of propulsion of propeller 32.

Figure 9:
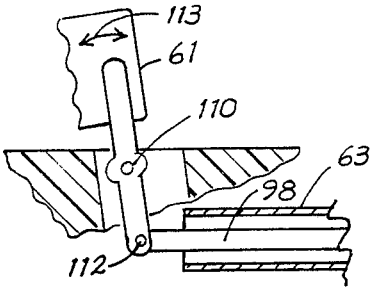
FIG. 9 is a partial cross-sectional and cut-away view of a further embodiment of the steering handle at the left portion of FIG. 8.

FIG. 9 shows a further embodiment for coupling steering handle 61 to rotatable motor support shaft 34. Handle 61 in FIG. 9 is supported on pivot pin 110 attached to platform 10 (or cowling 22) and connected to actuation means 98 by additional pivot pin 112. When steering handle 61 is rotated in a fore and aft direction as shown by arrow 113, actuation means 63 moves fore and aft, causing rotation of shaft 34 and motor 30. Other means for coupling steering handle 61 to rotating shaft 34 will also serve, such as for example, a cable and pulley wherein one pulley is located in a horizontal plane on shaft 34 and another pulley is located in a vertical plane at pivot 110 and attached to handle 61. A cable or belt extends around both pulleys. Rotational movement of handle 61 around pivot 110 pulls the belt or cable to cause rotation of shaft 34. Small angular movements of handle 61 may be made to produce large angular movements of shaft 34 or vice versa by having different size pulleys at pivot 110 and on shaft 34. Other means for coupling steering handle 61 to steering shaft 34 may also be used.

FIG. 6 illustrates a preferred construction of battery compartment 38 containing battery 36. Battery hold-down clamps are conveniently provided to prevent battery 36 from moving within compartment 38 when platform 10 is being transported, or launched and retrieved from the water. Battery 36 is conveniently of a rechargeable type which is sealed to prevent electrolyte leakage. Such batteries are well known in the art. Removable waterproof cover 37 is conveniently provided over battery compartment 38 to prevent flooding and discharge of the battery.

The speed control switches or means in propulsion control handle 60 are desirably of the "dead-man" type, that is, using a spring loaded switch or means which automatically returns to the "off" position when released. This prevents the platform from continuing to run should the operator inadvertently fall off, as for example due to an unexpected wave. A squeeze type switch or actuator means mounted on the forward part of the control handle 60 and adapted to be grasped by the operator's fingers is convenient for this purpose.

Because the invented viewing platform runs on stored energy and has positie steering it is much more easily directed than prior art units. Under certain circumstances it may be desirable to move astern as well as ahead. For that reason, switching means for reversing the direction of rotation of motor 30 and propeller 32 are desirable incorporated in the propulsion control means and its included power modulator. This is most conveniently accomplished by providing a reversing signal switch or means either in propulsion control handle 60 or nearby in or on cowl 22. Having the reversing means built into propulsion control handle 60 along with the speed control means is particularly desirable. This may be conveniently accomplished for example, by providing a two position "forward-reverse" switch on the side or top of handle 60 where it may be easily actuated by the operator's thumb. Since the platform is intended for use in the water the speed and direction control switches or means should be of a waterproof type.

Control handle 60 and steering handle 61 may be located on either side of platform 10. The arrangement illustrated has steering handle 61 on the operator's right hand and the propulsion control handle on the operator's left. The reverse arrangement may also be used.

Platform 10 must provide sufficient buoyancy to support itself and the operator. This is easily accomplished by filling the space between hull 12 and deck 14 with a material which is lighter than water. Plastic foam or air or a mixture thereof are suitable. The figures illustrate the arrangement wherein platform 10 is substantially solid, that is, made of a solid material of comparatively low density as compared to water. Light weight foamed plastic materials are suitable. It is desirable that hull 12, deck 14 and cowls 22 and 39 be constructed of an abrasion resistant material. Suitable plastics are well known in the art. It is also desirable that platform 10 be constructed of materials which when formed into the indicated shape provide a substantially rigid structure.

Those of skill in the art will appreciate that the invention described and illustrated above provides, among other things, an improved floating powered underwater viewing platform which has positive steering, variable speed propulsion, a large shaded viewing window which provides an improved field of view, controls which permit variable speed in forward or reverse and automatically shut off when the operator releases the control, navigation and power status instruments, underwater illumination, and improved operator comfort and endurance.

Those of skill in the art will understand that the details of the foregoing description are intended to be for purpose of illustration and not limitation, and that the invention may be implemented in various ways within the scope of the claims which follow and that all such variations are intended to be included within the scope of such claims and not limited to the particular examples provided. For example, the speed and range of the above-disclosed platform can also be used in varous search and rescue applications. A person using the subject invention can search more area in a given period of time than a team of divers can search in a significantly longer period of time.

I claim:

1. An underwater viewing sled comprising:

an elongated flotation platform means for completely supporting a person above an upper surface of a body of water having a bow and stern and a deck portion and hull portion and comprising a rigid material;

viewing means extending through said platform from said deck portion to said hull portion and having a leading portion located a first predetermined distance aft of said bow and a trailing portion located a second, larger, distance aft of said bow;

propulsion means operably coupled to said platform means for propelling said viewing sled, said propulsion means mounted substantially at said stern of said platform means;

power source means operable coupled with said propulsion means for supplying power thereto;

cowling means attached to said deck portion and extending above part of said deck portion and said viewing means from said bow toward said stern, wherein a first portion of said cowling extends toward said stern a third distance exceeding said first distance but less than said second distance;

actuating means comprising an actuating control having a first variable position switch for propulsion speed control and regulation of said propulsion means, said actuating means being located in a first lateral position adjacent said cowling means and substantially at one side of said platform; and directional control means for directing the course of said sled and having a steering handle located in a second lateral position adjacent said cowling means opposite said first lateral position, said cowling means extending aftward of said actuating control and said steering handle.

2. The underwater viewing sled of claim 1 wherein said viewing means comprises a lens having curved upper and lower surfaces.

3. The underwater viewing sled of claim 1 wherein said cowling means has a second portion extending toward said stern a fourth distance greater than said second distance.

4. The underwater viewing sled of claim 1 wherein said first part of said cowling means is located above said viewing means and wherein said cowling means has a second part extending toward said stern which substantially laterally encloses a port portion and a starboard portion of said viewing means extending between said leading and trailing portions of said viewing means.

5. The underwater sled of claim 1 further comprising illuminating means located on said hull and partly downwardly directed for lighting underwater scenes beneath said viewing means.

6. The underwater viewing sled of claim 1 wherein said actuating control has a second variable position switch for setting forward and reverse propulsion direction.

7. The underwater viewing sled of claim 6 wherein said second variable position switch is of a type which returns automatically to the off position when released by the operator.

8. The underwater viewing sled of claim 1 wherein said first variable position switch is of a type which returns automatically to the off position when released by the operator.

9. The underwater viewing sled of claim 1 wherein said propulsion means comprises an underwater mounted electric drive unit coupled to said platform by a substantially vertically arranged rotatable shaft, and wherein said direction control means comprises a first transversely oriented lever fixed to said shaft for rotating said shaft to change the direction of propulsion of said electric drive unit to port or starboard and a linkage means for connecting said lever to said steering handle.

10. The underwater viewing sled of claim 9, wherein said power source means comprises an electric battery means for powering said electric drive unit, and further comprising an instrument means for indicating at least one condition of the group comprising battery charge status and battery drain indication.

11. The underwater viewing sled of claim 9 wherein said rotatable shaft is coupled to said platform by first and second aftward extensions to said platform having substantially vertical holes therein to accommodate said rotatable shaft passing therethrough and retained therein by retention means.

12. The underwater viewing sled of claim 1 wherein said deck extends laterally outside said cowling aft of said actuating means and said steering handle to accommodate arm rests thereupon.

13. The underwater viewing sled of claim 1 further comprising directional indicator means.

14. A powered flotation platform for supporting a person in water and permitting underwater viewing therethrough, comprising:

an elongated lighter than water platform means having a head end and a foot end and sides extending therebetween for completely supporting a person above an upper surface of a body of water, and having a lower surface adapted to face into said water and an upper surface for receiving a substantially prone person lying face downward thereon;

underwater viewing means penetrating said platform near said head end and having therein a lens with at least one curved surface;

sunshade means extending from said upper surface of said platform near said had end toward said foot end over part of said viewing means by a first distance and extending alongside said viewing means toward said foot end a second distance greater than said first distance thereby forming a substantially U-shaped opening having divergent arms extending toward said foot end of said platform for accommodating the face of said substantially prone person without obstructing the mouth or nose;

a power unit located at said foot end of said platform for providing propulsion;

steering means located laterally adjacent a first of said sides for varying the direction of propulsion; and speed control means located laterally adjacent a second of said sides for varying the speed of propulsion, said sunshade means extending aftward of said speed control means and said steering means.

15. The powered flotation platform of claim 14 further comprising resilient cushion means on upper and footward facing portions of said U-shaped opening for cushioning the face resting therein.

16. The powered flotation platform of claim 14 wherein said steering control means and speed control means are located between said sunshade means and said sides of said platform.

* * * * *